US005495991A

United States Patent [19]

Raasch et al.

[11] Patent Number: 5,495,991

[45] Date of Patent: Mar. 5, 1996

[54] APPARATUS FOR TRANSPORTING EMPTY YARN WINDING TUBES AND FULLY WOUND TEXTILE YARN PACKAGES TO AND FROM A WINDING LOCATION

[75] Inventors: Hans Raasch; Heinz-Dieter Gobbels; Wolfgang Loers, all of Monchengladbach, Germany

[73] Assignee: W. Schlafghorst AG & Co., Moenchengladbach, Germany

[21] Appl. No.: 222,129

[22] Filed: Apr. 4, 1994

[30] Foreign Application Priority Data

Apr. 24, 1993 [DE] Germany ..... 43 13 522.6
Jan. 26, 1994 [DE] Germany ..... 44 02 143.7

[51] Int. Cl.[6] ..... B65H 54/02; D01H 9/14

[52] U.S. Cl. ..... 242/35.5 A; 57/281

[58] Field of Search ..... 57/90, 281; 242/355 A

[56] References Cited

U.S. PATENT DOCUMENTS

| | | | |
|---|---|---|---|
| 3,534,539 | 10/1970 | Franzen et al. | 57/281 |
| 3,879,925 | 4/1975 | Yoshizawa et al. | 242/35.5 AX |
| 4,856,270 | 8/1989 | Langen et al. | 57/281 |
| 4,895,313 | 1/1990 | Burysek et al. | 242/35.5 A |
| 5,092,452 | 3/1992 | Nakayama | 242/35.5 AX |
| 5,092,532 | 3/1992 | Meroni et al. | 242/35.5 A |
| 5,165,615 | 11/1992 | Polnik | 242/35.5 A |
| 5,167,115 | 12/1992 | Wernli et al. | 57/90 X |
| 5,177,949 | 1/1993 | Stadele et al. | 57/90 X |
| 5,184,785 | 2/1993 | Inger et al. | 242/35.5 A |
| 5,185,993 | 2/1993 | Fritschi et al. | 57/90 X |
| 5,211,000 | 5/1993 | Fink et al. | 57/90 X |

FOREIGN PATENT DOCUMENTS

| | | |
|---|---|---|
| 0491065A1 | 6/1992 | European Pat. Off. . |
| 0521279A1 | 1/1993 | European Pat. Off. . |
| 8700472U1 | 6/1987 | Germany . |
| 8633536U1 | 5/1988 | Germany . |
| 8633535U1 | 5/1988 | Germany . |
| 3719091A1 | 12/1988 | Germany . |
| 3832249A1 | 4/1989 | Germany . |
| 4001253A1 | 7/1991 | Germany . |
| 4131481A1 | 3/1993 | Germany . |

*Primary Examiner*—Daniel P. Stodola
*Assistant Examiner*—Michael R. Mansen
*Attorney, Agent, or Firm*—Shefte, Pinckney & Sawyer

[57] ABSTRACT

An apparatus for removing fully wound cheese-type textile yarn packages from a textile machine and replacing them with empty yarn winding tubes comprises an endless transport apparatus having a plurality of transport units connected via a traction member. Each transport unit has a freely accessible, upwardly facing transport receiver surface which is selectively used for receiving a completed cheese package as well as receiving an empty replacement tube. The exchange of a full package for an empty tube is performed by means of a traveling servicing unit on the textile machine, equipped with, among other things, a tube gripper for handling the empty replacement tubes and servicing elements for handling the completed cheese packages.

21 Claims, 7 Drawing Sheets

APPARATUS FOR TRANSPORTING EMPTY YARN WINDING TUBES AND FULLY WOUND TEXTILE YARN PACKAGES TO AND FROM A WINDING LOCATION

BACKGROUND OF THE INVENTION

The present invention relates to an apparatus for transporting empty yarn winding tubes and fully wound textile yarn packages to and from a winding location, particularly in a textile machine wherein yarn packages in the form of cross-wound cheeses are produced, e.g., an open end rotor type yarn spinning machine.

Textile machines of the basic above-described type typically have a plurality of work stations arranged in side-by-side alignment along the length of the machine with some form of a transport apparatus extending along the work stations for delivering empty winding tubes and removing fully wound yarn packages, sometimes commonly referred to as cheeses, to and from the work stations.

A representative transporting apparatus of this general type is disclosed in German Patent Publication DE 40 01 253A, for example, wherein the textile machine has two rows of work stations extending in the longitudinal direction of the machine and a cheese and tube transport apparatus centrally disposed between the rows. The transport apparatus is constructed as a continuous-loop conveyor having a plurality of transport elements each equipped with a receiver for a fully wound cheese-type package and a receiver for an empty winding tube. The transport elements are in the form of suspended gondolas configured with a trough for receiving the finished cheeses and a holder for an empty tube disposed above the trough. Handling of the cheeses or the empty tubes is performed by a servicing unit which travels along the textile machine and is equipped with handling devices suitable for these operations.

German Utility Model DE-GM 86 33 535 or German Utility Model DE-GM 87 00 472 disclose comparable transport apparatus. Transport elements are suspended from continuous support rails, each element having a device for transporting cheeses and a further device for transporting one or a plurality of empty tubes.

The known transport apparatus have disadvantages which heretofore have prevented such apparatus from being accepted in actual operations.

SUMMARY OF THE INVENTION

It is accordingly an object of the present invention to provide a transport apparatus for textile cheese packages and empty tubes which is suitable for actual use in commercial operations without the disadvantages of the known apparatus and assures a problem-free supply of empty cheese-winding tubes and removal of fully wound cheese packages to and from a textile machine.

In accordance with the present invention, this object is accomplished by providing a transport means having a plurality of transport units each having a freely accessible transport receiver configured for receiving a fully wound yarn package from a receiver work station of the textile machine or an empty yarn-winding tube.

This arrangement of the present invention offers the particular advantage that the transport receivers of the transport units are freely accessible from above the textile machine which considerably simplifies the mechanical structure of an automatic tube-gripping device, for example.

Furthermore, the transport receivers of the individual transport units are designed for supplying empty tubes to the work stations as well as for transporting away from the work station finished cheese packages, which accomplishes a simple and very compact construction of the transport units.

Advantageously, each of the transport units is equipped with running gear, for example in the form of supporting wheels on the underside of the unit partially disposed within the body of the transport unit, so that the transport units as a whole are embodied to be relatively low in height.

The transport units may be coupled together via a driveable traction member to form an endless transport assembly, with the units supported by their running gear on tracks disposed at a rear side of the work stations and somewhat lower in elevation than the winding devices of these work stations. The low construction of the transport units, together with the disposition of the tracks, results in a very small overall structural height of the transport apparatus, which has advantages in regard to the stability of the transport units as well as to the possibilities for use of tube grippers disposed on the servicing unit.

The transport receivers of the transport units have support surfaces inclined in the shape of a V, which assure the correct positioning of the transported items, whether an empty tube or a fully wound cheese package.

In a preferred embodiment, the V-shaped support surfaces have a central transport trough so that the transport of a cheese as well as an empty tube simultaneously is possible. The structural height of the transport units does not essentially change even in this embodiment.

According to a further feature of the invention, the transport units are connected by means of clamping elements to a traction member, with the clamping elements being spaced from one another so that the center-to-center spacing between the individual transport units conforms to the spacing of the work stations of the textile machine.

At the ends of the transport means, deflection wheels are provided to guide the traction member in a circulating fashion. It has been found to be particularly advantageous if one of the deflection wheels is connected with a drive, while another deflection wheel is acted upon by a tensioning device. In addition, at least the driven deflection wheel is provided with a crown gear, the pitch of which is conformed to the spacing of the clamping elements as well as to a distance corresponding to the spacing being adjacent sections of the textile machine.

Preferably, the spacing between the clamping elements is a whole number multiple of the spacing between the clamping elements as well as the size of the pitch of the driving deflection wheel. A continuous drive of the transport units free of slippage is assured in this manner.

The track on which the transport units are supported is angled downwardly from the horizontal plane in the area of the opposite ends of the textile machine. In this case, the clamping elements are supported on guides to prevent the traction member from being downwardly deflected into the angled area.

The clamping elements may preferably be made of two components with a recess for inserting the traction member, so that the traction member is fixed in this recess when the two clamping components are affixed together. The walls defining the recess of the clamping elements are preferably conformed to the circumference of the deflection wheels disposed at the ends of the transport apparatus. In this manner, the traction member is prevented from bending damage in the course of traveling over the deflection wheels.

It is particularly advantageous if at least one of the multiple clamping elements is designed to engage the opposite ends of the traction member, which makes the manufacture of an endless traction member easier. This clamping element is of a configuration similar to a link of a chain and has at least one clamping insert which is seated in a rotatably movable manner.

The unloading and loading of the transport units at the work stations of the textile machine may be performed by means of an automatic servicing unit which can travel along the machine. Among other things, the servicing unit has a tube gripper which can be positively controlled by means of a control device. In the course of exchanging a finished fully wound cheese-type yarn package for an empty tube, the tube gripper first takes up the empty tube and moves it into an intermediate position. Subsequently, the finished package is pushed into the transport receiver of a transport unit positioned at the respective work station by means of other handling elements disposed on the servicing unit, such as frame openers and bobbin ejectors. Then the tube gripper transfers the empty tube to a creel of a bobbin winding device at the work station. In this case, the transfer of the empty tube takes place in a predetermined position in which tube support arms are lifted away from a winding drum of the bobbin winding device.

Preferably, the tube gripper is rotatably fastened on a console of the servicing unit located at a distance above the transport apparatus. For example, the tube gripper may be in the form of a telescoping gripper, wherein the telescoping components of the tube gripper can be extended via traction means such as drive belts. Alternatively, the extension and retraction of the gripping device of the tube gripper may be accomplished by means of electrical, pneumatic or hydraulic drive systems.

It is particularly advantageous if the tube gripper element is disposed at the free end of a boom formed as a component of an articulated linkage mechanism. In this case, the boom may be pivotably guided in two hinge joints, with a support and control lever rotatably seated on the console of the servicing unit acting on the lower hinge joint while the upper hinge joint is connected with the console via a control lever and an intermediate guide link. The intermediate guide itself is pivotable via an actuating lever, with a length compensating gear being disposed between these components.

DETAILED DESCRIPTION OF THE PREFERRED EMBODIMENT

Figure 1:
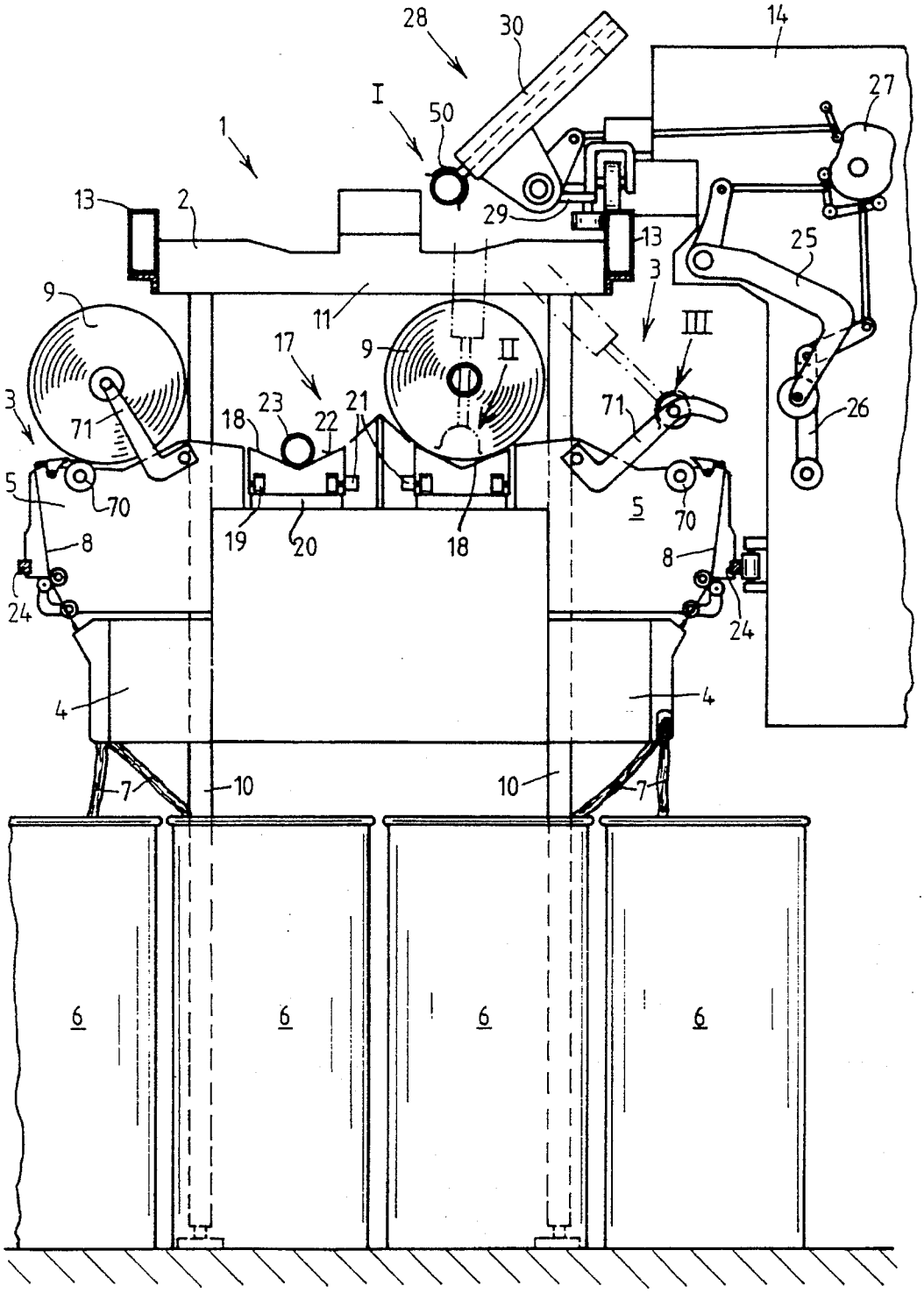
FIG. 1 is an end view of a textile machine equipped with a transporting apparatus in accordance with the present invention.

FIG. 1 shows a textile machine, identified as a whole at 1, in the exemplary embodiment of an open end spinning machine. Such spinning machines essentially consist of a machine frame 2 with work stations 3 disposed in alignment along both sides of the frame. As is known and therefore not shown in detail, each of the work stations 3 has a spinning unit 4 and a winding head 5. A sliver 7 supplied from sliver cans 6 is spun into a yarn 8 in the spinning unit 4 and is subsequently wound into a cheese-type package 9 on the winding head 5.

The machine frame usually has a plurality of vertical support structures 10 which are connected via cross members 11 as well as horizontal braces. In addition, guide rails 13 for a traveling servicing unit 14 are disposed on the cross members 11.

A transport apparatus 17 is disposed in the area below the cross members 11, i.e., between the cross members 11 and the central portion of the machine frame, at the rear of the winding heads 5. The transport apparatus 17 basically consists of a plurality of individual transport units 18 each of which is provided with an interiorly mounted running gear in the form of wheels 19 for traveling movement along a track 20. The transport units 18 are either embodied as independent pusher elements or, as shown in the drawings, may preferably be connected with one another in the form of a circulating endless transport device via a traction member 21 driven by a drive wheel (not shown).

Each of the transport units 18 has an upwardly facing V-shaped receiver portion 22 which can selectively receive either an empty yarn winding tube 23 or a fully wound cheese package 9.

Figure 4:
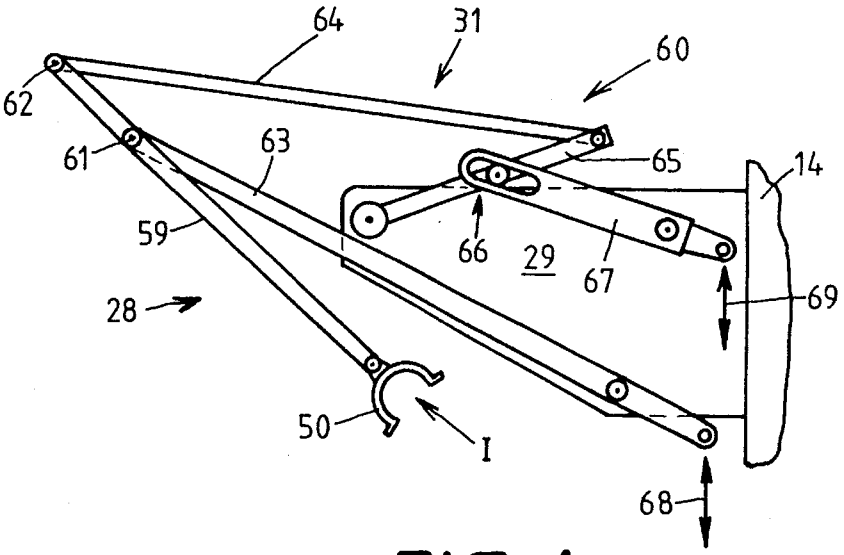
FIG. 4 is a side view of an alternative embodiment of a tube gripper, shown in a resting position.
Figure 6:
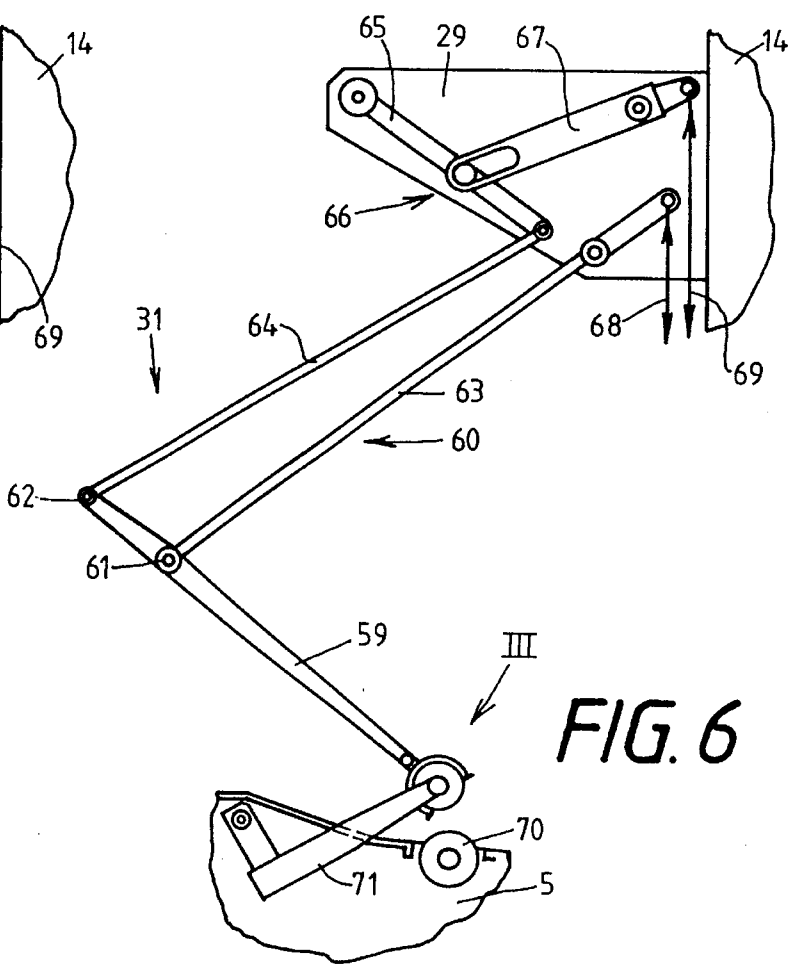
FIG. 6 is another side view of the tube gripper of FIGS. 4 and 5, shown transferring the gripped tube to a work station of the textile machine.
Figure 5:
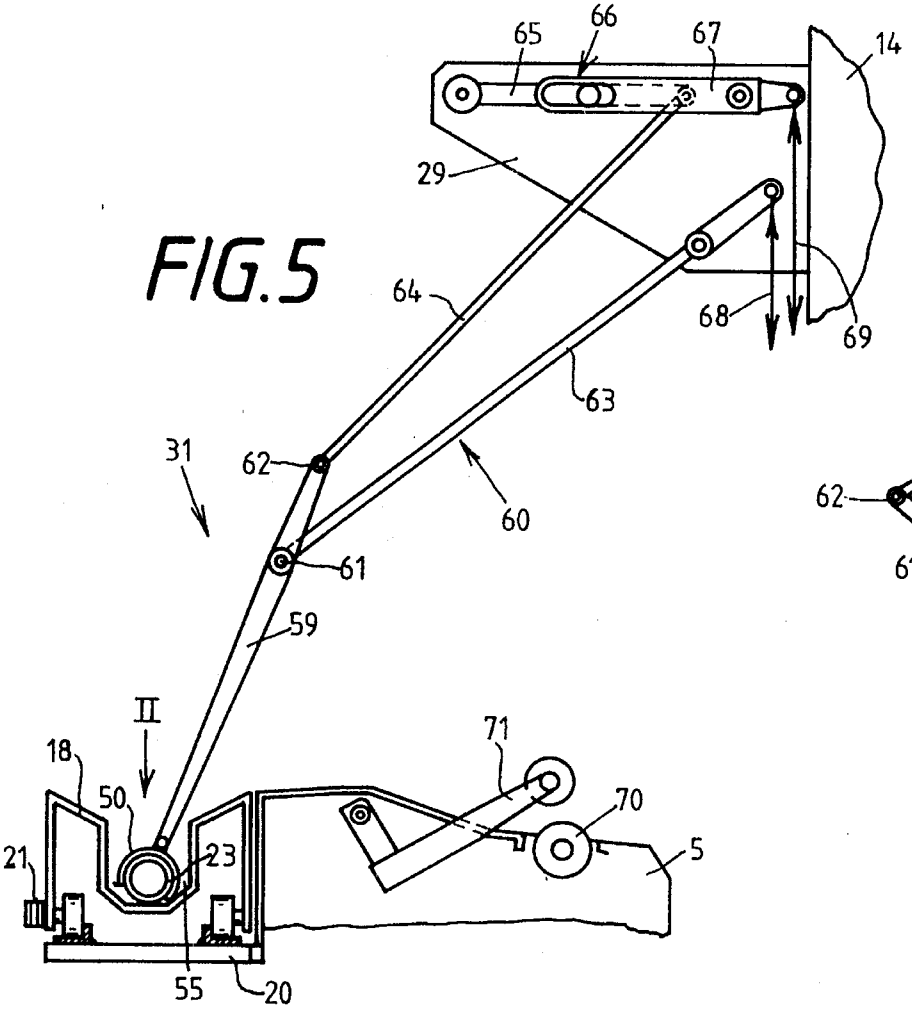
FIG. 5 is another side view of the tube gripper in accordance with FIG. 4, shown in operation gripping an empty tube from a transport unit of the present invention.

The automatic servicing unit 14 is guided on the guide rail 13 affixed to the cross members 11 for traveling movement along the work stations 3. As can be seen in FIG. 1, the servicing unit 14 is also supported on a longitudinal support rail 24 disposed on the winding heads 5. As is customary, the servicing unit 14 is equipped with a tube gripper 28, as well as a number of additional tube and cheese handling devices, of which only a bobbin ejector 25 and a frame opener 26 are indicated. The tube gripper 28 is disposed on a console portion 29 of the servicing unit 14 above the guide rail 13 and the cross members 11. The tube gripper 28 and the handling devices 25,26 are controlled in a known manner by means of a disk cam mechanism 27. As shown in FIGS. 1 and 2, the tube gripper 28 can be embodied as a telescoping gripper 30 or, as shown in FIGS. 4, 5 and 6, as a boom gripper 31.

Figure 2:
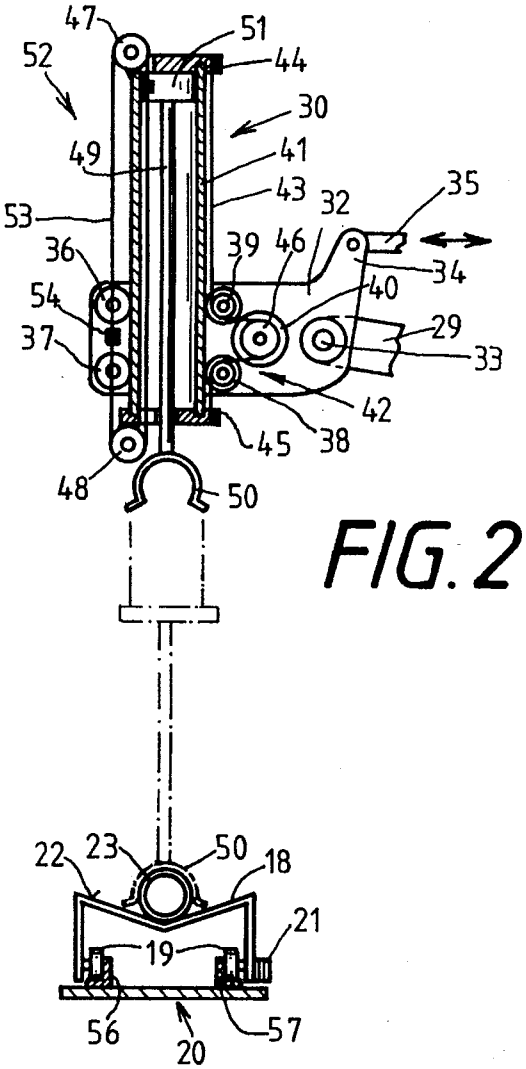
FIG. 2 is a detailed view, partially in section, of a telescoping tube gripper in operation with a first embodiment of a transport unit according to the present invention.

As can be seen in particular from FIG. 2, the telescoping gripper 30 has a support frame 32 which is connected via a shaft 33 with the console 29 of the servicing unit 14. In addition, the support frame 32 has a neck portion 34 which enables the angular position of the support frame 32 to be set via a reciprocable bar 35. The support frame 32 additionally has guide rollers 36–39 as well as a gear motor 40 by which an exterior tube 41 of the telescoping gripper 30 is clamped between the guide rollers 36–39 for movement via a belt drive arrangement 42. In particular, the belt drive arrangement 42 consists of a drive belt 43 which is fixed at its ends by clamps 44,45 and is guided over the guide rollers 38,39 and the drive wheel 46 of the gear motor 40. Each rotation of the gear motor 40 in a clockwise direction therefore serves to extend the exterior tube 41 of the gripper 30.

A telescoping rod 49 is displaceably guided within the tube 41 via a guide piston 51 contained slidably within the tube 41, and a tube gripper element 50 is affixed to the opposite free end of the rod 49. The guide piston 51 is connected to a further belt drive arrangement 52 having a drive belt 53 guided about deflection rollers 47,48 mounted to the opposite ends of the tube 41. The belt 53 is fixed by means of a clamp 54 on the support frame 32 of the telescoping gripper 30. As will thus be understood, the telescoping rod 49 is extended simultaneously with each extension of the exterior tube 41, so that the gripper element 50 is advanced into the position shown in broken lines in FIG. 2, in which an empty tube 23 may be lifted from the transport receiver 22 of a transport unit 18.

Figure 3:
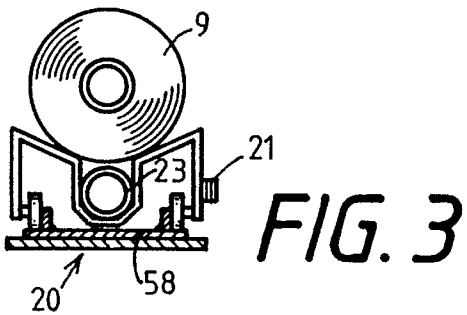
FIG. 3 is an end view of a further embodiment of a transport unit according to the present invention.

The transport units 18, which as aforementioned are combined into a circulating endless transport apparatus 17 via a traction member 21, either have a V-shaped transport receiver 22, as indicated in FIG. 2, or additionally have a transport trough 55 disposed along the center of the V-shaped transport receiver 22, as indicated in FIG. 3. An embodiment of this latter type permits the simultaneous transport of an empty tube 23 and a full cheese 9, as shown in FIG. 3.

The running gear 19 of each transport unit 18 is guided on a track 20 which either consists of two individual rails 56,57, as shown in FIG. 2, or is embodied as a continuous plate-like track 58, as shown in FIG. 3.

Figure 7:
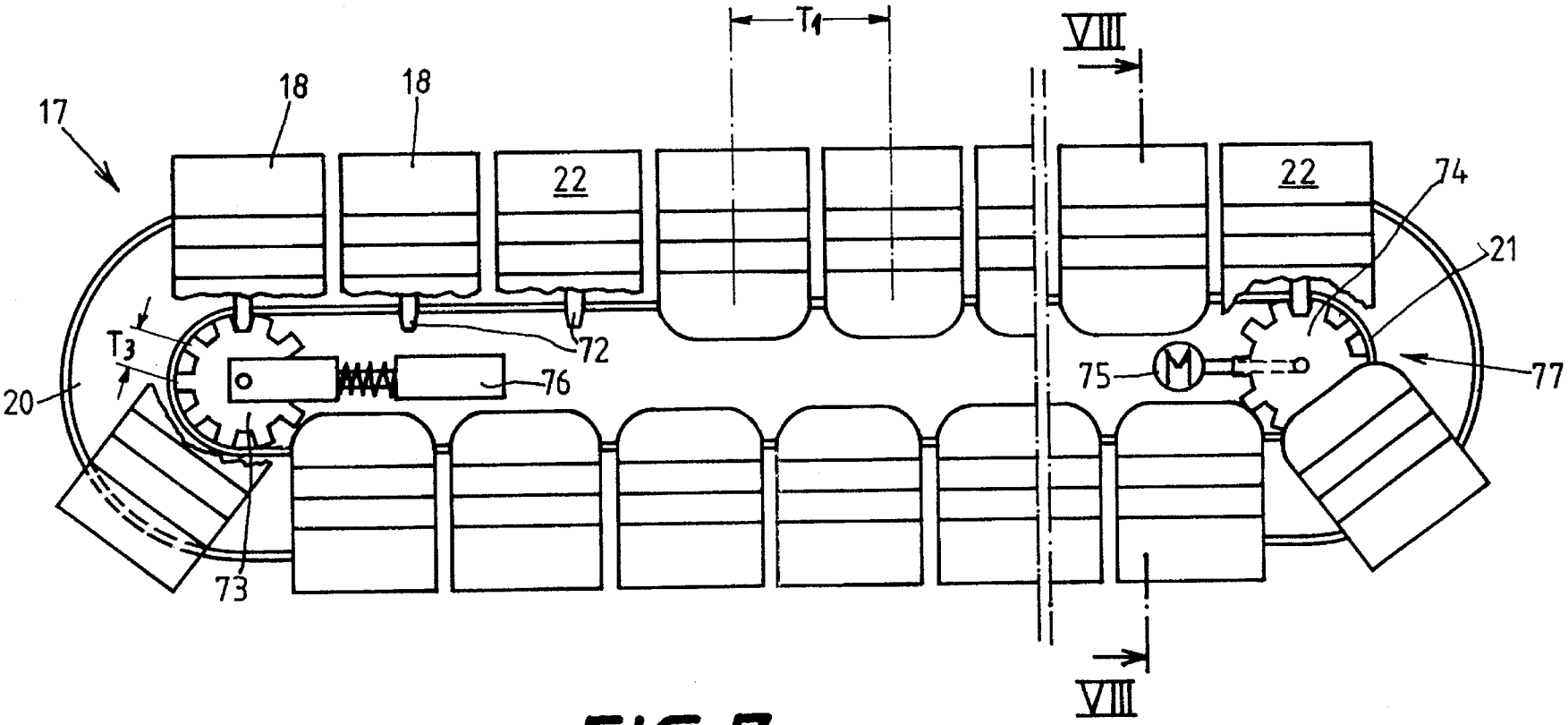
FIG. 7 is a top plan view of another embodiment of transporting apparatus adapted for circulating movement above a textile machine.
Figure 10:
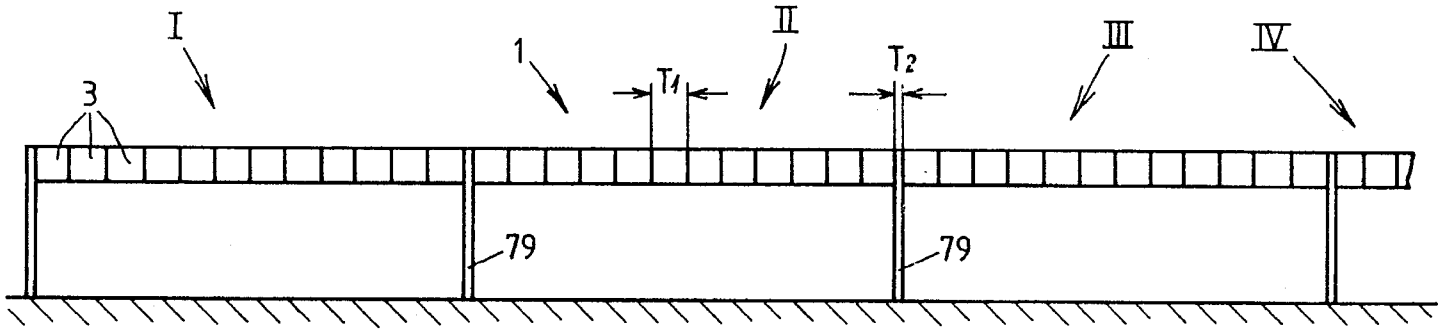
FIG. 10 is a schematic view of a textile machine consisting of a plurality of machine sections.

As can be seen in FIG. 7, the traction member 21 is supported at the ends of the textile machine by a pair of deflection wheels 73,74. In this illustrated embodiment, the deflection wheel 74 is connected with a drive motor 75 for driving the transport apparatus 17 in the direction of the arrow R. The oppositely located deflection wheel 73 is displaceably seated and is acted upon by a tensioning device 76. As indicated in FIG. 7, at least the deflection wheel 74 has a crown gear 77, the pitch $T_3$ of which is conformed to the spacing $T_1$ between the clamping elements 72 by which the transport units 18 are affixed to the traction member 21, as well being conformed to the spacing $T_2$ between adjacent sections I, II, III, IV, etc., of the textile machine (each comprising plural work stations 3) as indicated at 79 (see FIG. 10). Here, the spacing $T_1$ between the clamping elements 72 is conformed to the spacing of the work stations 3 of the textile machine 1 and is a whole number multiple of the spacing $T_2$ occurring in the area of the machine section boundaries 79.

Figure 8:
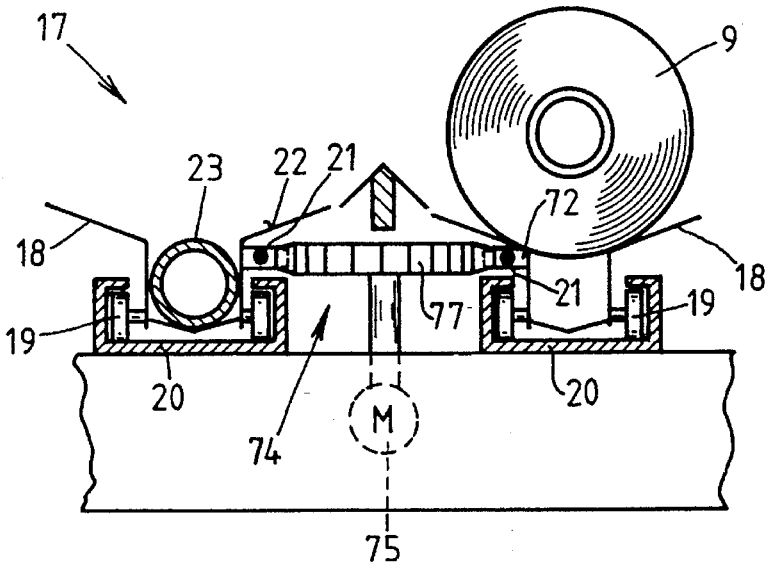
FIG. 8 is a vertical cross-sectional view of the transporting apparatus of FIG. 7, taken along line VIII—VIII of FIG. 7.
Figure 9:
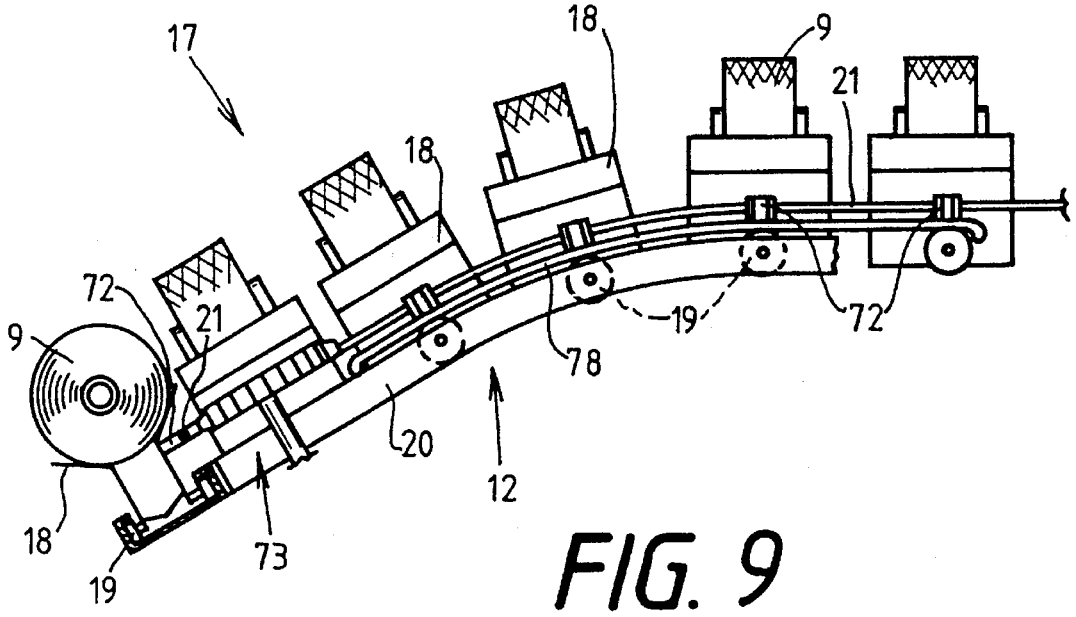
FIG. 9 is a side view of the transporting apparatus of FIGS. 7 and 8 at one downwardly angled end section thereof.

In the embodiment illustrated in FIGS. 7 to 9, the running gear of the transport units 18, which as indicated are connected via the clamping elements 72 with the traction member 21, are guided in track 20 in the form of a U-shaped profiled rail section. The track 20 can be angled downwardly in the area of the opposite ends of the machine, as indicated at 12 in FIG. 9. In such a case, guides 78 are provided along the end sections of the track 20 for supporting the clamping elements 72 in the angled area to prevent the traction member 21 from migrating downward.

Figure 11:
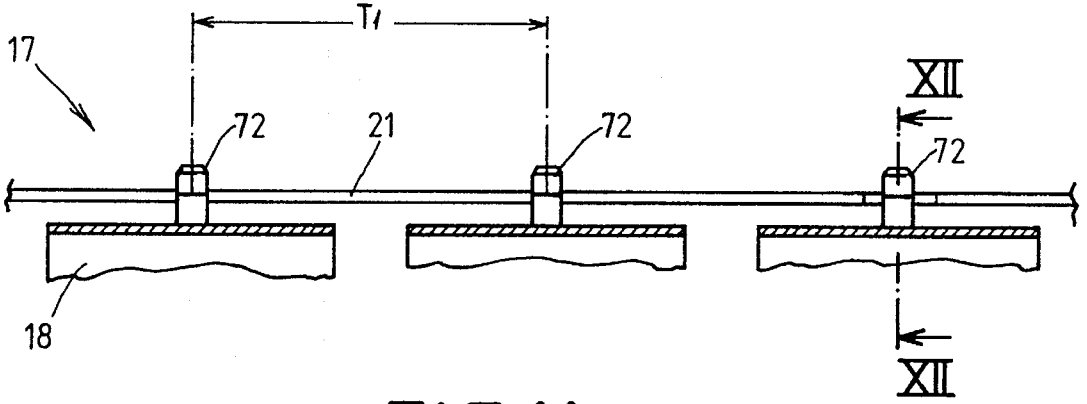
FIG. 11 is an enlarged top plan view of a traction member for the present transporting apparatus.
Figure 12:
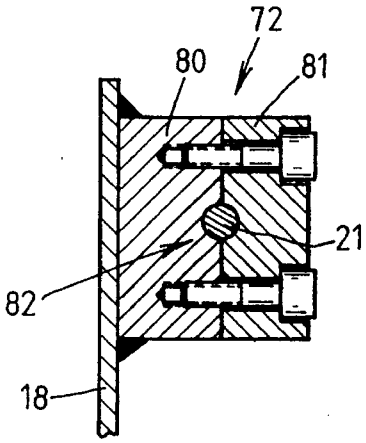
FIG. 12 is a vertical cross-sectional view through one clamping element of the traction member of FIG. 11, taken along the section XII—XII of FIG. 11.
Figure 13:
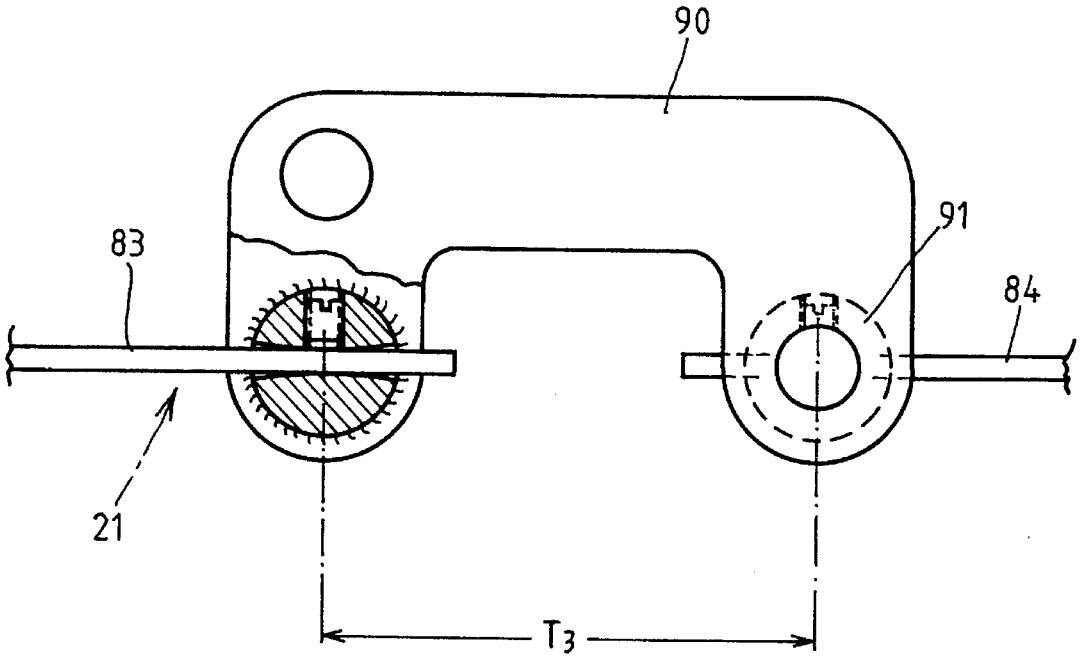
FIG. 13 is a side view of one clamping element of a traction member for the present transporting apparatus, adapted for fixing the opposite ends of the traction member together.

As indicated in FIGS. 11 and 12, the clamping elements 72 are preferably made of two mating components in the form of a cover element 81 bolted to a base body 80, which together define a recess 82 in which the traction member 21 is clamped and thereby securely fixed. The traction member 21 may be successfully configured in an endless form by employment of a specially constructed clamping element 90. As shown in FIG. 13, the clamping element 90 is of a configuration similar to a link in a chain and has at least one clamping insert 91 rotatably seated at its ends for the limited movable fastening of the opposite ends 83,84 of the traction member 21.

FIGS. 4 to 6 illustrate a preferred embodiment of the tube gripper 28 as a boom gripper. As can be seen, the tube gripper element 50 is fastened to a free end of a boom 59 which is affixed as a component of an articulated linkage gear mechanism, indicated at 60. On its end opposite the tube gripper element 50, the boom 59 has hinge joints 61 and 62. A support and control link 63 acts on the hinge joint 61, while a control lever 64 is connected to the other hinge joint 62 and is indirectly connected with the console 29 via an intermediate guide link 65. The intermediate guide link 65 itself is connected via a length compensating device 66 with an actuating lever 67. The support and control link 63 or the actuating lever 67 are connected via mechanical force transmitting means, for example reciprocating draw bars 68,69, to a control device, such as the disk cam mechanism 27.

Operation of the present transport apparatus may thus be understood. When any one of the work stations 3 of the textile machine 1 has completed the winding of a cheese package 9 by its winding head 5 to the full predetermined capacity necessitating that the package 9 be doffed and replaced with an empty tube 23 so that the winding operation can continue, the servicing unit 14 is signalled to travel as quickly as possible to this work station and is positioned at the work station in a manner which is known in the art.

Thereupon, the tube gripper 28 disposed on the servicing unit 14 is pivoted from its normal resting position of FIG. 4 toward a transport unit 18 disposed adjacent the work station on the transport track 20 and into the position II of FIG. 5 wherein the tube gripper 28 grasps the empty tube 23 disposed on the transport receiver 22 or, as illustrated in FIG. 5, in the transport trough 55 of the transport unit 18. In the course of or preparatory to this operation, the endless transport apparatus 17 is operated to locate the respective transport unit 18 in a predetermined position at the rear of the winding head 5. After gripping the empty tube 23, the tube gripper 28 carrying the gripped empty tube moves to an intermediate operating position wherein the gripper element 50 of the tube gripper 28 is elevated or otherwise spaced from the winding head 5 of the winding station 3 so that the cheese transfer can proceed, e.g., the tube gripper 28 may be returned to the initial starting position I, of FIG. 4.

The servicing unit 14 which, as mentioned, has a number of additional handling devices, such as the frame opener 26 and the cheese ejector 25 (FIG. 1), now grips with the frame opener 26 a resiliently seated arm of the bobbin holder 71 from underneath and pushes it laterally toward the outside of the machine frame, so that the cheese 9 is released. Subsequently the cheese is pushed laterally rearwardly of the frame by means of the cheese ejector 25 in the direction of the transport apparatus 17 to cause the package 9 to roll into the V-shaped transport receiver 22 of the adjacent transport unit 18.

Thereupon, the tube gripper 28 pivots into the position III of FIG. 6 and transfers the empty tube 23 held by the gripper element 50 to the bobbin holder 71 which is kept in a released or open position by the frame opener 26. As indicated in FIGS. 1 and 6, at the time of the transfer of the empty tube, the bobbin holder 71 is in a position in which the empty tube 23 is still lifted off the driven winding drum 70.

The servicing unit 14 preferably has an external yarn transfer device. After the empty tube transfer has been completed, the servicing unit 14 restarts the spinning operation and transfers the yarn to the empty tube 23 now held in the bobbin holder 71. Then the empty tube 23 is lowered onto the driven winding drum 70 to complete the tube exchange process. The servicing unit 14 is then free to proceed to the next service procedure.

The full cheese package 9 now supported on the transport apparatus 17 is either temporarily stored there to be transported away from the work station 3 only when tube exchange operations have been performed at each work station 3 for the entire machine or for predetermined sections of the machine (for example, the right or left machine side, certain sections of the machine, etc.), or the package 9 may be immediately transported away from the work station. In either case, the package is conveyed to a transfer station (not shown) disposed alongside the machine, at which the package 9 is removed from the transport apparatus 17, preferably by an automatic package loading device. At the same time an empty tube 23 is transferred to the transport receiver 22 or to the transport trough 55 in preparation for another tube exchange operation.

Overall, it will therefore be understood that the apparatus of the present invention represents a clear improvement over the transport devices heretofore known and is distinguished by a large range of uses and high efficiency, not in the least due to its relatively low structural height and the simple and rugged mechanical construction of its individual components.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An apparatus for transporting empty yarn-winding tubes and fully wound textile yarn packages to and from a textile machine having a plurality of adjacently arranged yarn-winding work stations each with a winding head, said apparatus comprising:

a plurality of transport units configured for selectively carrying one of an empty tube and a wound yarn package to and from the yarn-winding stations, each said transport unit having an upwardly facing transport receiver surface that is freely accessible from above, an endless guide track partially disposed along one side of the work stations laterally adjacent the winding head of each work station, means disposed on said transport units for guiding said transport units along said guide track, means for joining said transport units in a transport assembly along said guide track, means for driving said transport assembly along said guide track, means positionable above said transport units for lifting empty tubes off said transport receiver surfaces and transferring the empty tubes to the work stations, and means for laterally displacing wound textile yarn packages from the winding heads onto said transport receiver surfaces.

2. An apparatus in accordance with claim 1, wherein said transport units comprise carriages and said guiding means disposed on each said transport unit comprise wheels underneath said carriages for traveling movement of said carriages along said guide track.

3. An apparatus in accordance with claim 1, further comprising a traveling servicing unit movable along the textile machine to all of the work stations, said lifting means and said displacing means disposed on said traveling servicing unit.

4. An apparatus in accordance with claim 3, wherein said transport receiver surface of each said transport unit is V-shaped.

5. An apparatus in accordance with claim 3, wherein each said transport receiver surface is V-shaped for receiving and transporting a yarn package and has a transport trough formed in said V-shaped surface for receiving and transporting an empty tube at the same time.

6. An apparatus in accordance with claim 3, wherein said lifting means comprises a tube gripper which is movable together with an empty tube from an intermediate position to a transfer position at a winding head of one of the work stations.

7. An apparatus in accordance with claim 6, wherein said displacing means comprises a bobbin ejector which is operative after said tube gripper has been moved into the intermediate position to transfer a yarn package from the winding head of one of the work stations onto a said transport receiver surface of a said transport unit.

8. An apparatus in accordance with claim 6 wherein said tube gripper is pivotably disposed on said servicing unit for projecting in the direction of a said transport receiver surface from above.

9. An apparatus in accordance with claim 8, wherein said tube gripper comprises a tube gripper element and an actuating linkage having a boom carrying said tube gripper element at a free end thereof.

10. An apparatus in accordance with claim 9, wherein said actuating linkage comprises hinge means pivotably supporting said boom and a control device for operating said hinge means.

11. An apparatus in accordance with claim 10, wherein said control device of said actuating linkage comprises an actuating lever and a length compensating gear, wherein said actuating lever operates on said hinge means via said length compensating gear.

12. An apparatus in accordance with claim 6, wherein the tube gripper is telescopical.

13. An apparatus in accordance with claim 12, wherein the tube gripper comprises a telescoping rod with a tube gripper element on one end of the rod and drive belts for extension and retraction of the tube gripper element.

14. An apparatus in accordance with claim 12, wherein, the tube gripper comprises a tube gripper element and means for extending and retracting the tube gripper element.

15. An apparatus in accordance with claim 3, wherein said joining means comprises a circulating traction member fastened to said transport units, said transport units being spaced from one another along said traction member in correspondence to the spacing of the work stations of the textile machine.

16. An apparatus in accordance with claim 15, further comprising clamping elements for fastening said transport units to said traction member, each clamping element comprising at least one component having a recess for said traction member.

17. An apparatus in accordance with claim 15, further comprising a clamping element configured for connecting together opposite ends of said traction member to form an endless loop.

18. An apparatus in accordance with claim 3, wherein said driving means comprises at least two deflection wheels, a drive, and tensioning means, and wherein said traction member is in drivable disposition with said deflection wheels, said drive is connected to one of said deflection wheels, and said tensioning means acts on the other of said deflection wheels to tension said other deflection wheel into said traction member.

19. An apparatus in accordance with claim 18 for transporting empty yarn-winding tubes and fully wound textile yarn packages to and from a textile machine having sections of a plurality of adjacently arranged yarn-winding work stations each with a winding head, wherein said deflection wheel connected to said drive comprises a crown gear having a tooth pitch conforming to a spacing between said transport units and to a spacing between adjacent sections of winding stations of the textile machine.

20. An apparatus in accordance with claim 19, wherein said spacing between said transport units conforms to the spacing between the work stations and is a whole number multiple of said spacing between adjacent sections of winding stations of the textile machine.

21. An apparatus in accordance with claim 3, wherein said guide track is angled in an end area of the textile machine, and further comprising a guide rail for guiding said traction member at the angled extent of said guide track.

* * * * *